US006799367B2

(12) United States Patent
Hori

(10) Patent No.: US 6,799,367 B2
(45) Date of Patent: Oct. 5, 2004

(54) MANUFACTURING METHOD FOR A SPARK PLUG

(75) Inventor: Koji Hori, Kuwana (JP)

(73) Assignee: Denso Corporation (JP)

( * ) Notice: Subject to any disclaimer, the term of this patent is extended or adjusted under 35 U.S.C. 154(b) by 206 days.

(21) Appl. No.: 10/021,024

(22) Filed: Dec. 19, 2001

(65) Prior Publication Data

US 2002/0078555 A1 Jun. 27, 2002

(30) Foreign Application Priority Data

Dec. 26, 2000 (JP) ..... 2000-395526

(51) Int. Cl.[7] ..... H01C 1/03

(52) U.S. Cl. ..... 29/616; 29/592.1; 29/615; 29/619; 313/141; 338/238

(58) Field of Search ..... 29/592.1, 610.1, 29/614–616, 619, 620; 313/118–143, 145; 338/66, 268; 419/62

(56) References Cited

U.S. PATENT DOCUMENTS 3,967,230 A * 6/1976 Kamigaito et al. ..... 338/66
6,137,211 A * 10/2000 Sugimoto et al. ..... 313/145
6,406,983 B1 * 6/2002 Holzlein et al. ..... 438/522

FOREIGN PATENT DOCUMENTS

JP 11-251033 9/1999

* cited by examiner

*Primary Examiner*—Peter Vo
*Assistant Examiner*—Donghai D. Nguyen
(74) *Attorney, Agent, or Firm*—Nixon & Vanderhye PC

(57) ABSTRACT

A windbreak provided along a side of a tray prevents insulators located close to an entrance of a furnace from being directly cooled by the air coming into the furnace. All of the insulators mounted on the tray can be uniformly cooled when conveyed out of the furnace after finishing a sintering operation. A resistance value of the electric resistor in an insulator located close to the entrance is substantially equalized with a resistance value of the electric resistor in another insulator located far from the entrance.

14 Claims, 7 Drawing Sheets

CENTER ELECTRODE INSTALLATION

GLASS POWDER STUFFING AND PRESS

RESISTIVE MATERIAL STUFFING AND PRESS

GLASS POWDER STUFFING & STEM INSTALLATION AND PRESS

HEATING

THERMAL PRESS
2
5
7
8
8a
8b
10
12
13

MANUFACTURING METHOD FOR A SPARK PLUG

BACKGROUND OF THE INVENTION

The present invention relates to a method for manufacturing a spark plug which has an electric resistor interposed between a center electrode and a stem and causes a spark discharge between the center electrode and a ground electrode.

Unexamined Japanese patent publication No. 11-251033 discloses a conventional manufacturing method for a spark plug.

According to this manufacturing method, an electric resistive powder material chiefly containing a glass component is stuffed in an inside hollow space of an insulator. A plurality of insulators each accommodating the resistive powder material are heated together in a furnace. After being thermally processed, these insulators are conveyed out of the furnace. Next, the stem is depressed into each insulator under a lower-temperature atmosphere. Then, a metallic housing equipped with a ground electrode is securely assembled with the insulator by caulking.

Heating the insulator in the furnace is to sinter the electric resistive powder material to form an electric resistor located between the center electrode and the stem in the insulator. The electric resistance value of thus sintered electric resistor is dependent on a component ratio of the resistive powder material and also dependent on a sintering temperature in the furnace.

SUMMARY OF THE INVENTION

Through numerous experiences the inventor has found the fact that suppressing the dispersion of resistance values of electric resistors accommodated in a plurality of insulators thermally processed together becomes difficult when the resistance value of an electric resistor exceeds 3 kΩ, even if the material component ratio and the sintering temperature are carefully controlled.

As a result of a detailed inspection, the inventor has reached a conclusion that a cooling rate of each insulator gives a great influence on a resulting resistance value of the sintered electric resistor. This is similar to the phenomenon that mechanical properties (i.e., hardness and tensile strength) of a carbon steel vary depending on the cooling rate.

Especially, when a plurality of insulators are conveyed out of a furnace, some insulators positioned close to the entrance of the furnace are cooled early by the air coming into the furnace. Such a local cooling by the air coming into the furnace is believed to cause a large dispersion of resistance values among the sintered electric resistors.

Accordingly, the present invention has an object to provide a manufacturing method for a spark plug capable of suppressing the dispersion of electric resistance values among a plurality of insulators when thermally processed together.

In order to accomplish the above and other related objects, the present invention provides a first method for manufacturing a spark plug which has a center electrode and a ground electrode to cause a spark discharge and has an electric resistor interposed between the center electrode and a stem equipped with a terminal. The first manufacturing method comprises a step of stuffing an electric resistive powder material in an inner hollow space of each insulator into which the center electrode and the stem are installed, a step of heating a plurality of insulators in a furnace, a step of uniformly cooling the plurality of insulators when the plurality of insulators are conveyed out of the furnace, and a step of inserting the stem in the inner hollow space of each insulator.

The first manufacturing method makes it possible to substantially equalize a resistance value of the electric resistor in an insulator located close to the entrance with a resistance value of the electric resistor in another insulator located far from the entrance. Accordingly, the first manufacturing method effectively suppresses the dispersion of electric resistance values among a plurality of spark plugs. The first manufacturing method not only improves the yield of the spark plug but also reduces the manufacturing cost for the spark plug.

The present invention provides a second method for manufacturing a spark plug which has a center electrode and a ground electrode to cause a spark discharge and has an electric resistor interposed between the center electrode and a stem equipped with a terminal. The second manufacturing method comprises a step of stuffing an electric resistive powder material in an inner hollow space of each insulator into which the center electrode and the stem are installed, a step of mounting a plurality of insulators each accommodating the electric resistive powder material on a tray, a step of conveying the tray carrying the plurality of insulators into a furnace via an entrance of the furnace, a step of heating all of the plurality of insulators mounted on the tray in the furnace, a step of conveying the is, tray mounting the plurality of insulators thereon out of the furnace, and a step of inserting the stem in the inner hollow space of each insulator. The second method is characterized in that the tray has a windbreak positioned close to the entrance of the furnace when placed in the furnace for shielding the flow of air entering via the entrance.

The second manufacturing method makes it possible to prevent the insulator located close to the entrance of the furnace from being directly cooled by the air coming into the furnace when the tray mounting thermally processed insulators thereon is conveyed out of the furnace.

Accordingly, the second manufacturing method makes it possible to uniformly cool all of the insulators mounted on the tray when conveyed out of the furnace after finishing the sintering operation. The second manufacturing method makes it possible to substantially equalize a resistance value of the electric resistor in an insulator located close to the entrance with a resistance value of the electric resistor in another insulator located far from the entrance. Accordingly, the second manufacturing method effectively suppresses the dispersion of resistance values of the electric resistors accommodated in a plurality of insulators thermally processed together. The second manufacturing method not only improves the yield of the spark plug but also reduces the manufacturing cost for the spark plug.

According to a preferred embodiment of the second manufacturing method, the windbreak prevents a portion corresponding to the electric resistor from being directly cooled by the air.

This makes it possible to surely reduce the dispersion of resistance values of the electric resistors accommodated in a plurality of insulators thermally processed together.

The present invention provides a third method for manufacturing a spark plug which has a center electrode and a ground electrode to cause a spark discharge and has an electric resistor interposed between the center electrode and a stem equipped with a terminal. The third manufacturing method comprises a step of stuffing an electric resistive powder material in an inner hollow space of each insulator into which the center electrode and the stem are installed, a step of placing a plurality of insulators each accommodating the electric resistive powder material in receiving holes of a tray, a step of conveying the tray carrying the plurality of insulators into a furnace, a step of heating all of the plurality of insulators mounted on the tray in the furnace, a step of conveying the tray mounting the plurality of insulators thereon out of the furnace, and a step of inserting the stem in the inner hollow space of each insulator. The third manufacturing method is characterized in that each receiving hole of the tray is so deep that the portion corresponding to the electric resistor can be positioned or concealed in the receiving hole.

The third manufacturing method makes it possible to prevent the insulator located close to the entrance of the furnace from being directly cooled by the air coming into the furnace when the tray mounting thermally processed insulators thereon is conveyed out of the furnace.

Accordingly, the third manufacturing method makes it possible to uniformly cool all of the insulators mounted on the tray when conveyed out of the furnace after finishing the sintering operation. The third manufacturing method makes it possible to substantially equalize a resistance value of the electric resistor in an insulator located close to the entrance with a resistance value of the electric resistor in another insulator located far from the entrance. Accordingly, the third manufacturing method effectively suppresses the dispersion of resistance values of the electric resistors accommodated in a plurality of insulators thermally processed together. The third manufacturing method not only improves the yield of the spark plug but also reduces the manufacturing cost for the spark plug.

The present invention provides a fourth method for manufacturing a spark plug which has a center electrode and a ground electrode to cause a spark discharge and has an electric resistor interposed between the center electrode and a stem equipped with a terminal. The fourth manufacturing method comprises a step of stuffing an electric resistive powder material in an inner hollow space of each insulator into which the center electrode and the stem are installed, a step of mounting a plurality of insulators each accommodating the electric resistive powder material on a tray, a step of conveying the tray carrying the plurality of insulators into a furnace via an entrance of the furnace, a step of heating all of the plurality of insulators mounted on the tray in the furnace, a step of conveying the tray mounting the plurality of insulators thereon out of the furnace, and a step of inserting the stem in the inner hollow space of each insulator. The fourth manufacturing method is characterized in that the tray has a configuration for enlarging a cooling rate of an insulator located far from the entrance of the furnace compared with a cooling rate of an insulator located close to the entrance of the furnace.

The fourth manufacturing method makes it possible to positively cool the insulator located far from the entrance of the furnace. Accordingly, the fourth manufacturing method makes it possible to substantially equalize the cooling rates of respective insulators mounted on the tray so that all of the insulators mounted on the tray can be uniformly cooled when conveyed out of the furnace after finishing the sintering operation.

The forth manufacturing method makes it possible to substantially equalize a resistance value of the electric resistor in an insulator located close to the entrance with a resistance value of the electric resistor in another insulator located far from the entrance. Accordingly, the fourth manufacturing method effectively suppresses the dispersion of resistance values of the electric resistors accommodated in a plurality of insulators thermally processed together.

According to a preferred embodiment of the fourth manufacturing method, the tray has receiving holes for receiving respective insulators. A depth of a receiving hole provided close to the entrance of the furnace is deeper than a depth of a receiving hole provided far from the entrance of the furnace.

This makes it possible to surely reduce the dispersion of resistance values of the electric resistors accommodated in a plurality of insulators thermally processed together.

The present invention brings great effects when the electric resistor is equal to or larger than 3 kΩ.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENTS

Figure 1:
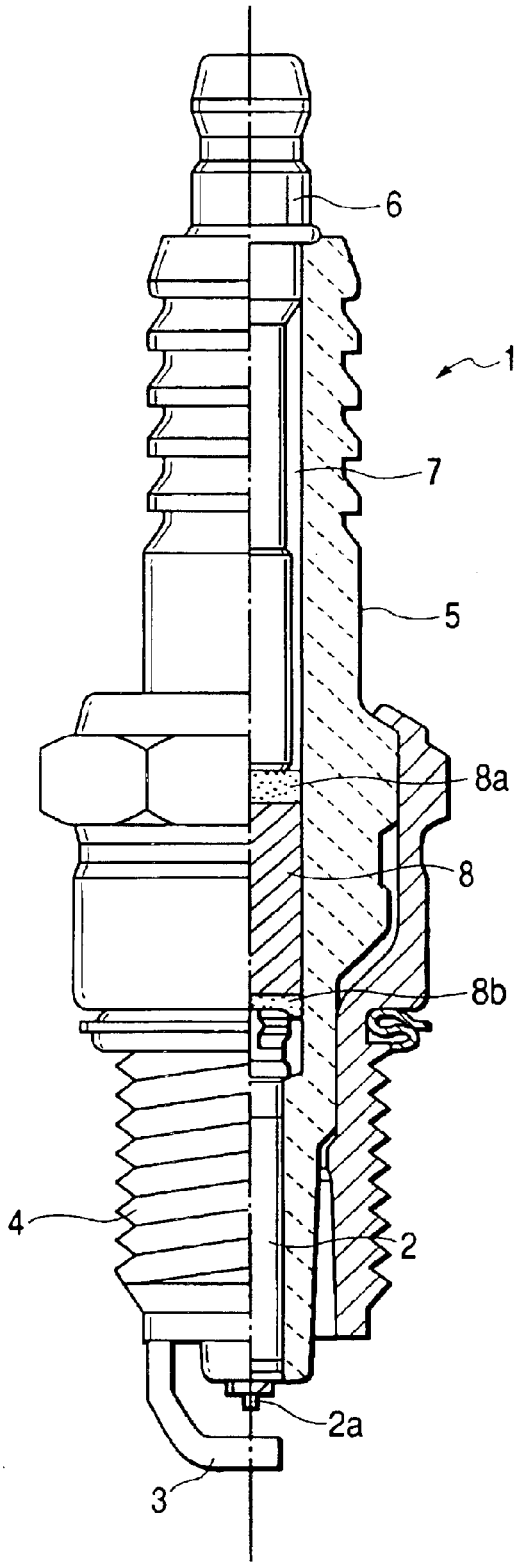
FIG. 1 is a half cross-sectional view showing a spark plug in accordance with a first embodiment of the present invention.

Preferred embodiments of the present invention will be explained hereinafter with reference to attached drawings. Identical parts are denoted by the same reference numerals throughout the drawings.

First Embodiment

The first embodiment of the present invention discloses a manufacturing method for a spark plug used in an internal combustion engine.

FIG. 1 shows a half cross-sectional view showing a spark plug 1 applicable to an internal combustion engine.

The spark plug 1 comprises a center electrode 2 located on the center axis thereof and a ground electrode 3 fixed to an axial end of a cylindrical metallic housing 4. The metallic hosing 4 is made of an electrically conductive steel member (e.g., low carbon steel). The metallic housing 4 has an inside space for fixedly holding a cylindrical insulator 5. The insulator 5 is made of an alumina ceramic ($Al_2O_3$) or a comparable electrically insulating material. One end of insulator 5 protrudes out of the metallic housing 4.

A metallic stem 7, provided with a terminal 6, is positioned in an axially extending inner hollow space of the insulator 5. An electric resistor 8, having a predetermined resistance value (e.g., 3 kΩ), is positioned between the stem 7 and the center electrode 2 in the axial direction of the spark plug 1.

In response to application of a predetermined voltage, the spark plug 1 causes an electric discharge (i.e., spark) between the center electrode 2 and the ground electrode 3 to ignite gaseous fuel.

The center electrode 2 has a cylindrical body consisting of an inner member, such as a copper or comparable metallic member, having excellent thermal conductivity and an outer member, such as a Ni-group alloy or comparable metallic member, having excellent heat resistance and corrosion resistance. An apical end 2*a* of center electrode 2 protrudes out of the insulator so as to form a discharge gap between the center electrode 2 and the ground electrode 3.

The ground electrode 3 is made of a Ni-group alloy containing Ni as a chief material. The ground electrode 3 has a proximal portion securely welded to the axial end of metallic housing 4. The ground electrode 3 is bent at an intermediate portion perpendicularly. A distal portion of ground electrode 3 and the apical end 2*a* of center electrode 2 cooperatively form the discharge gap.

To form the resistor 8, an electric resistive powder material chiefly containing a glass component mixed with a carbon powder is sintered in a furnace and configured into a rod or columnar shape of the resistor 8. Glass sealing layers 8*a* and 8*b*, made of electric conductive glass, are provided at longitudinal ends of the resistor 8 to prevent the combustion chamber side (including the center electrode 2) from communicating with the outside (including the terminal 6).

After forming the resister 8 in the insulator 5, the housing 4 is securely fixed with the insulator 5 by caulking (deforming) part of the housing 4.

The spark plug 1 of this embodiment is manufactured according to the following manufacturing method chiefly including the step of providing the resistor 8 in the insulator 5.

FIGS, 2A to 2F show processes for forming the resistor 8 in the inner hollow space of the insulator 5. First, as a center electrode installation process, the center electrode 2 is located at an axial end of the insulator 5 (refer to FIG. 2A). Then, as a first glass stuffing process, the electric conductive glass powder material is placed behind the center electrode 2 and pressed to form the glass sealing layer 8*b* (refer to FIG. 2B).

Figures 2A, 2B, 2C, 2D, 2E, 2F:
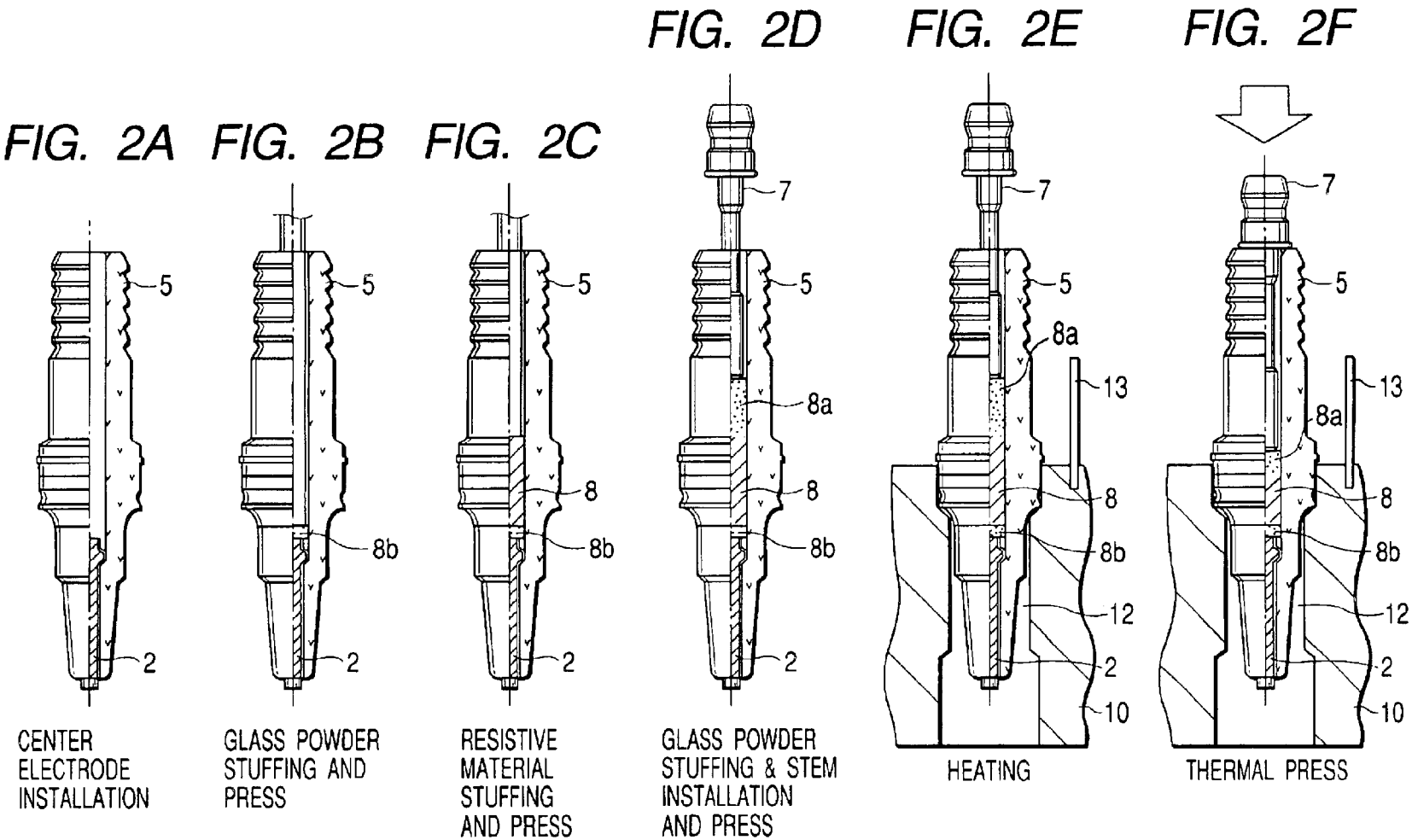
FIGS. 2A to 2F are views explaining a method for manufacturing the spark plug shown in FIG. 1 in accordance with the first embodiment of the present invention.

Next, as a resistor stuffing process, the resistive member is located on (next to) the conductive glass powder material and pressed (refer to FIG. 2C).

Next, as a second glass stuffing process, the electric conductive glass powder material is located on (next to) the resistor 8 and pressed by the stem 7 to form the glass sealing layer 8*a* (refer to FIG. 2D).

Figure 3:
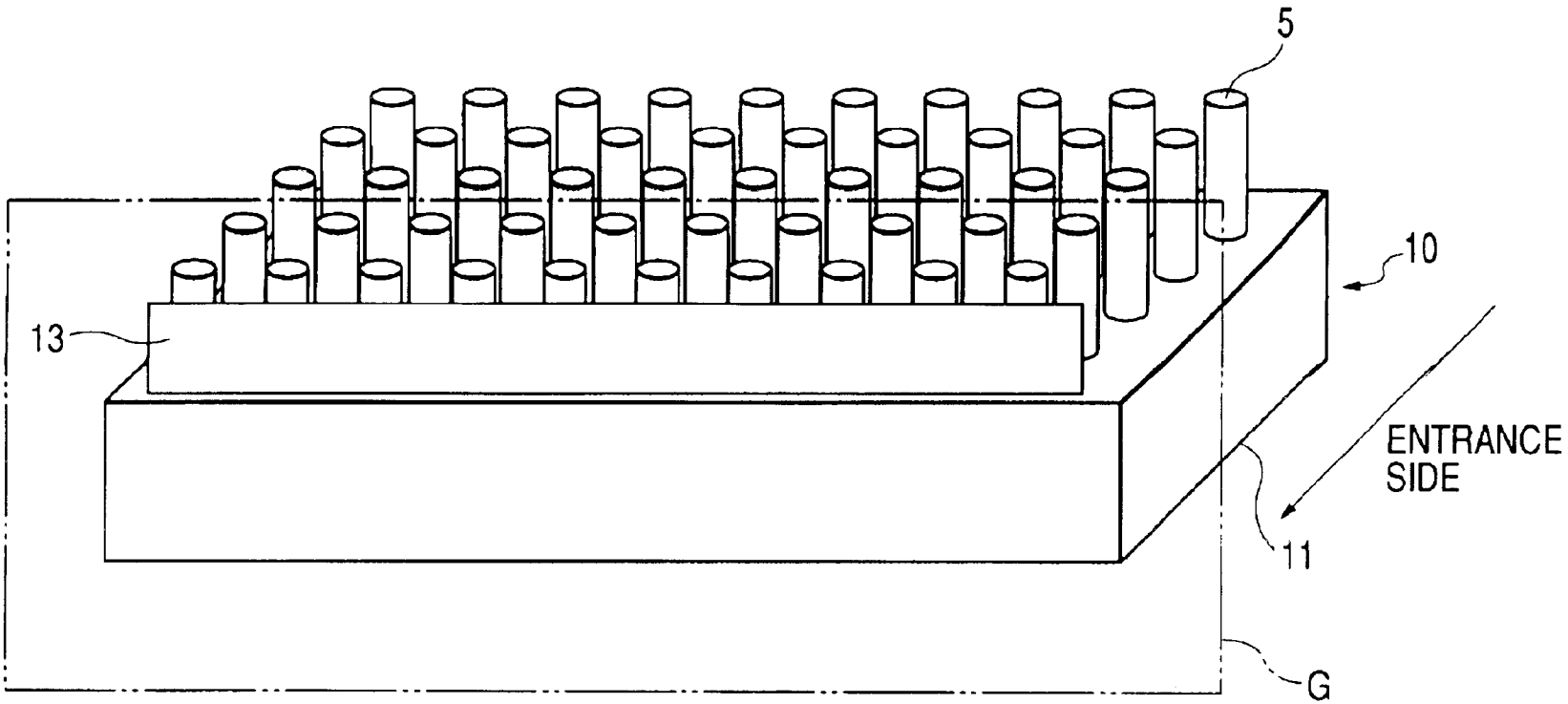
FIG. 3 is a perspective view showing a tray mounting a plurality of insulators thereon which is used in the manufacturing method of the first embodiment of the present invention.

Then, as shown in FIG. 3, a plurality of insulators 5 each accommodating the resistive member are placed on a metallic tray 10. Then, as a heating process, all of the insulators 5 mounted on the tray 10 are conveyed into an electric furnace (not shown) in which respective insulators 5 are heated at a predetermined sintering temperature (refer to FIG. 2E).

Figure 4:
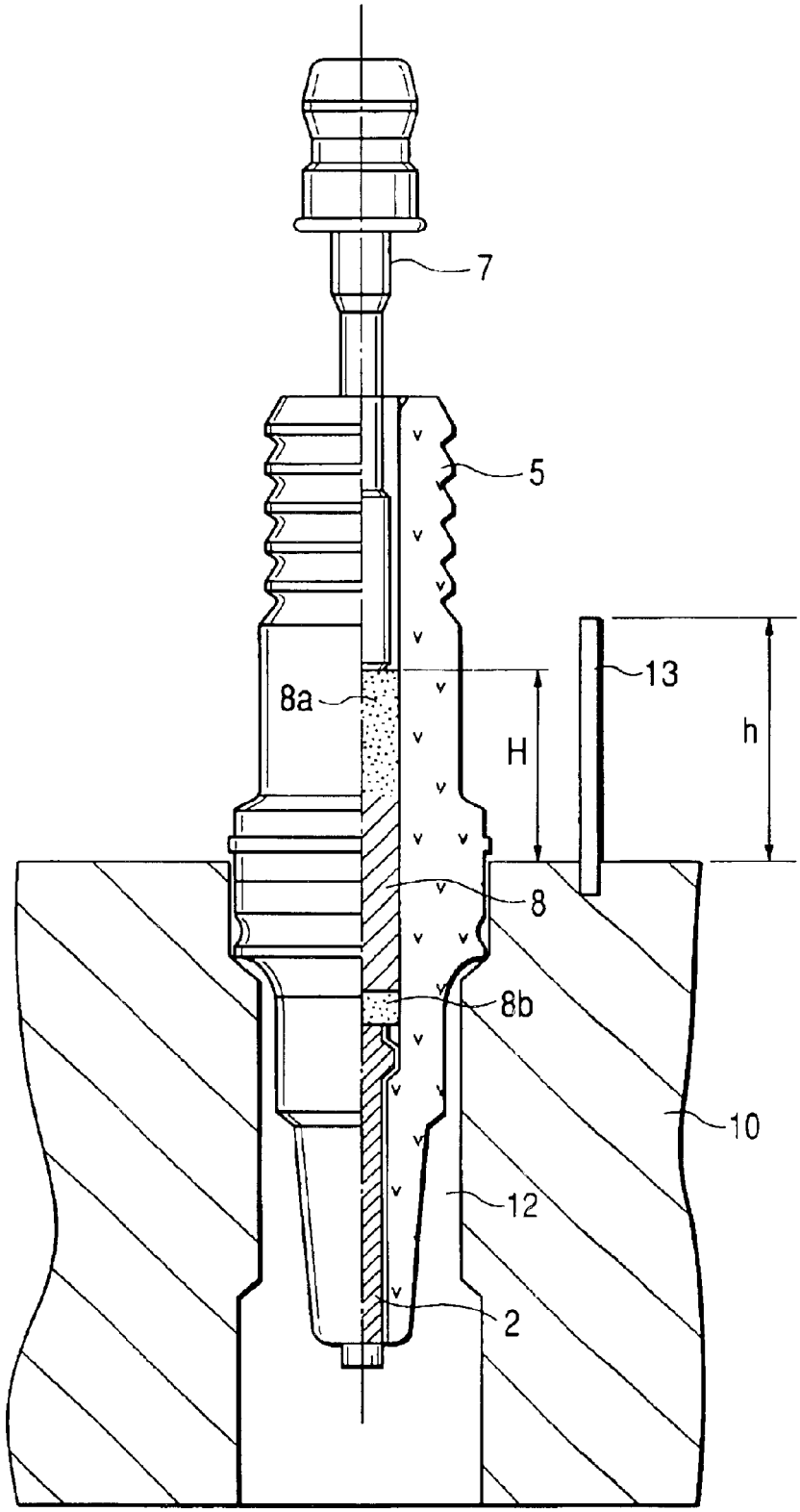
FIG. 4 is a partly cross-sectional view showing an insulator received in a hole of the tray which is used in the manufacturing method of the first embodiment of the present invention.

In this case, as shown in FIG. 4, the tray 10 has a rectangular base 11 having a plurality of holes 12 each receiving the insulator 5. A windbreak 13 is provided along one edge of the rectangular base 11 to prevent the insulators 5 from been cooled by the flow of air. When the tray 10 is in the electric furnace, the windbreak 13 is positioned close to an entrance G of the electric furnace.

The windbreak 13 is higher than the portion corresponding to the resistor 8 of the insulator 5 receiving in the hole 12 as shown in FIG. 4 to prevent the resistor 8 from being directly cooled by the air flowing into the electric furnace. More specifically, the height 'h' of windbreak 13 is larger than the height 'H' of the resister 8 at the time the second glass stuffing process is finished.

After accomplishing the heating process, all of the insulators 5 mounted on the tray 10 are conveyed out of the electric furnace. Then, as a depressing process, the stem 7 is depressed in the hollow space of insulator 5 by a press until the terminal 6 is brought into contact with the insulator 5. The depressing process must be accomplished before the resistor 8 and the glass sealing layers 8*a* and 8*b* are completely hardened. To this end, the ambient temperature of the insulator 5 is maintained at a level higher than the outside temperature.

The above-described embodiment has the following characteristics (effects and functions).

According to this embodiment, after the tray 10 is conveyed into the electric furnace, the windbreak 13 is positioned close to the entrance G of the electric furnace. When the tray 10 is conveyed out of the electric furnace after finishing the sintering operation, the windbreak 13 prevents the insulators 5 from being directly cooled by the air flowing into the furnace via the entrance G.

Accordingly, when the insulators 5 mounted on the tray 10 are conveyed out of the furnace after finishing the sintering operation, all of the insulators 5 can be uniformly cooled. This makes it possible to substantially equalize an electric resistance value of the resistor 8 in an insulator 5 located close to the entrance G with an electric resistance value of the resistor 8 in another insulator 5 located far from the entrance G. Accordingly, the manufacturing method of this embodiment effectively suppresses the dispersion of resistance values of the resistors 8 accommodated in a plurality of insulators 5 thermally processed together in the electric furnace. Thus, the manufacturing method of this embodiment not only improves the yield of the spark plug 1 but also reduces the manufacturing cost for the spark plug 1.

Furthermore, the windbreak 13 shields at least the portion corresponding to the resistor 8 of the insulator 5 against the air entering into the furnace via the entrance G. Thus, it becomes possible to substantially equalize the cooling rate of each insulator 5 (i.e., resistor 8) mounted on the tray 10. Thus, the dispersion of the electric resistance values of the manufactured resistors 8 can be surely suppressed.

Although the windbreak 13 of this embodiment is a simple belt-like plate, the windbreak of this invention is not limited to the one disclosed in FIG. 3 and therefore can be modified into various shapes as shown in FIGS. 5A to 5E.

Figure 5A:
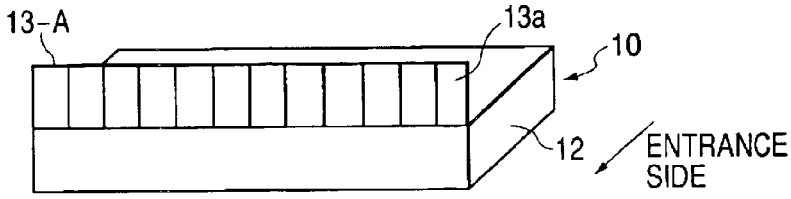
FIGS. 5A to 5E are perspective views showing different types of windbreaks applicable to the manufacturing method of the first embodiment of the present invention.
Figure 5B:
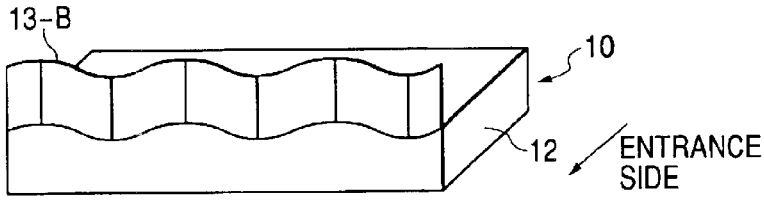
Figure 5C:
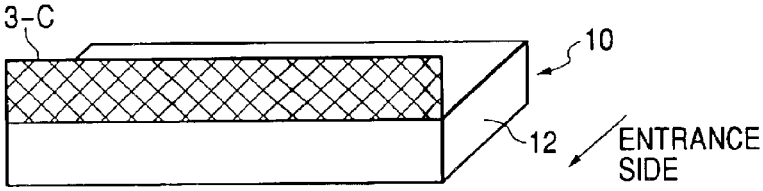
Figure 5D:
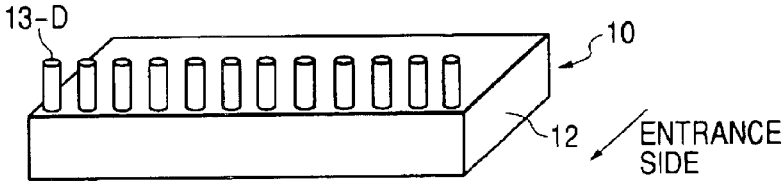
Figure 5E:
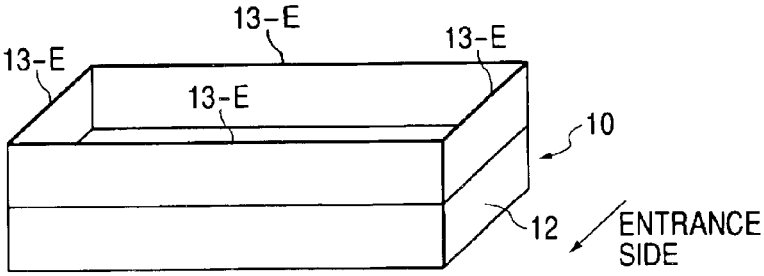

FIG. 5A shows a palisade windbreak 13-A having a plurality of slits (apertures) 13*a*. FIG. 5B shows a wavy windbreak 13-B. FIG. 5C shows a net or mesh windbreak 13-C like a punching or perforated metal having numerous openings. FIG. 5D shows columnar windbreak 13-D including numerous columnar dummy insulators arrayed in line. FIG. 5E shows a surrounding windbreak 13-E provided along all the edges of the rectangular tray 10.

The windbreak 13 is welded to the base 11 of the tray 10. However, it is possible to integrally form the windbreak 13 with the base 11.

Second Embodiment

Figure 6:
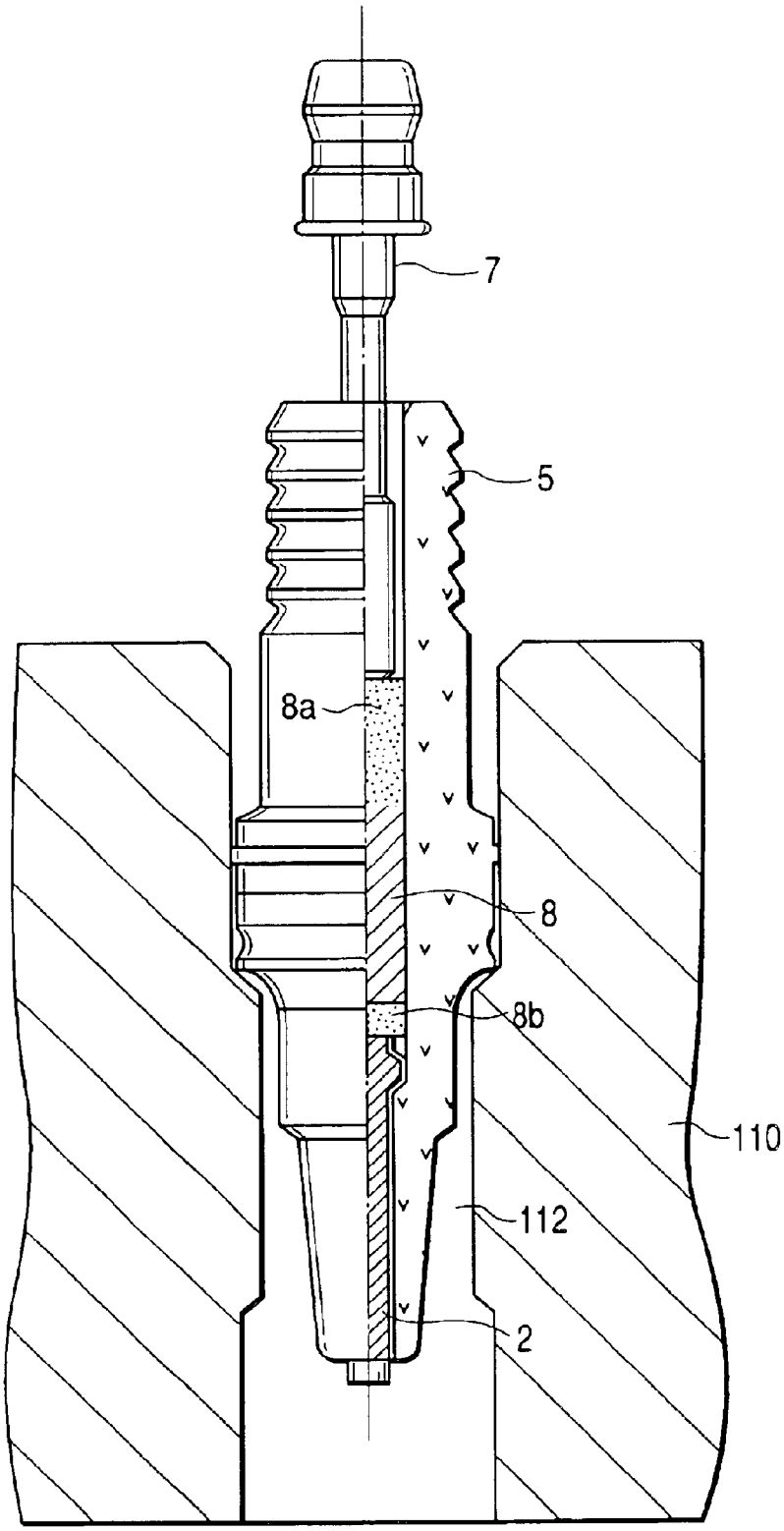
FIG. 6 is a partly cross-sectional view showing an insulator received in a hole of a tray which is used in a manufacturing method of a second embodiment of the present invention.

FIG. 6 shows a tray 110 according to the second embodiment of the present invention. A hole 112 of the tray 110 is so deep that the portion corresponding to the resistor 8 of the insulator 5 can be completely positioned or concealed in the hole 112.

Like the first embodiment, the second embodiment effectively presents the insulator 5 located in the vicinity of the entrance G of the furnace from being directly cooled by the air flowing into the furnace when the tray 110 is conveyed out of the furnace after finishing the sintering operation.

Third Embodiment

Figure 7:
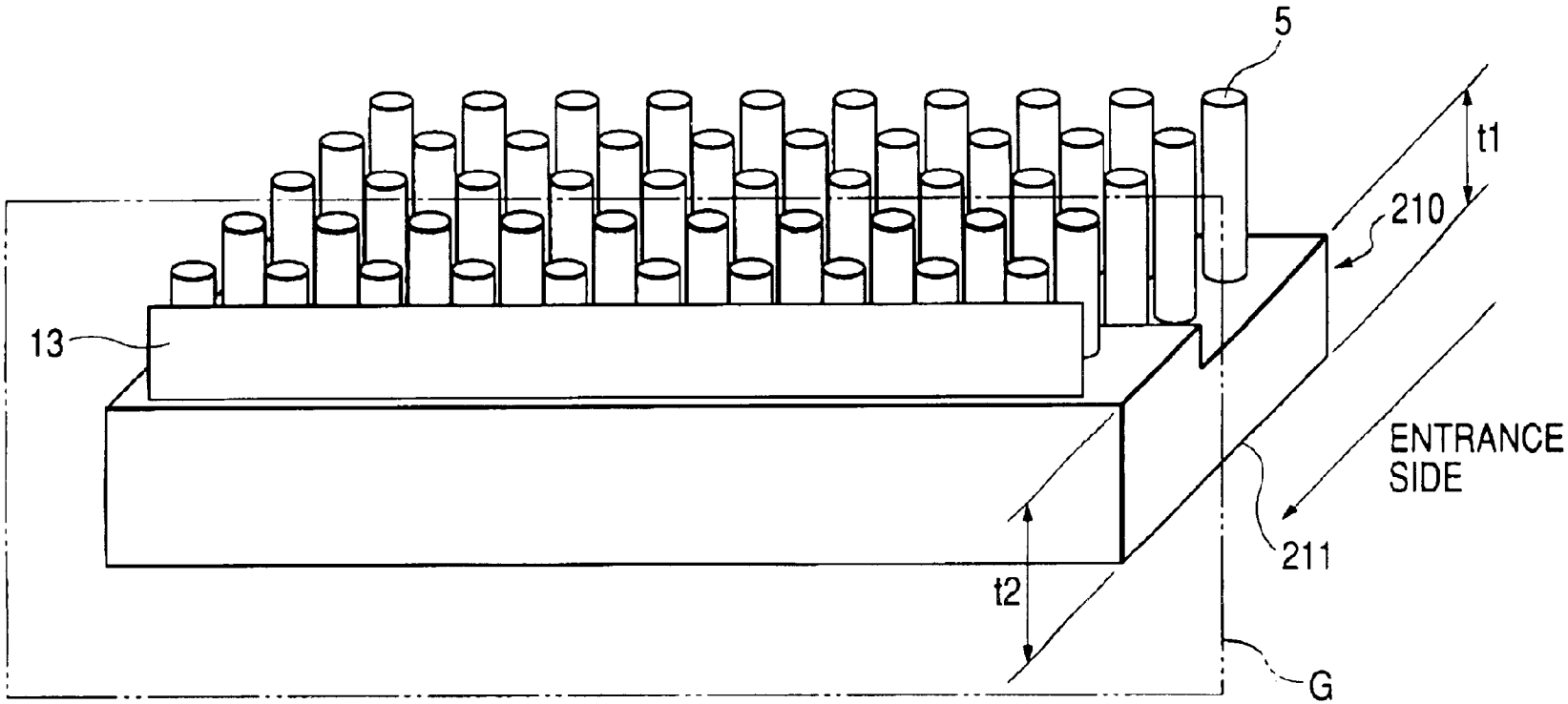
FIG. 7 is a perspective view showing a tray mounting a plurality of insulators thereon which is used in a manufacturing method of a third embodiment of the present invention.

FIG. 7 shows a tray 210 according to the third embodiment of the present invention. A thickness t2 of base 211 of tray 210 at one side, to be positioned close to the entrance G when placed in the electric furnace, is larger than a thickness t1 of base 211 at the opposite side, to be positioned far from the entrance G when placed in the electric furnace.

When the tray is conveyed out of the furnace, an insulator positioned close to the entrance G is exposed to the fresh and cool air at an earlier timing. Thus, a cooling rate of the insulator positioned close to the entrance G is relatively high compared with a cooling rate of an insulator positioned far from the entrance G.

According to the tray 210 of the third embodiment, a depth of a receiving hole provided close to the entrance G of the furnace is deeper than a depth of a receiving hole provided far from the entrance G of the furnace.

The insulator located far from the entrance G is exposed to the air at a relatively large surface compared with the insulator located close to the entrance G. This effectively compensates the cooling rate difference residing between the insulator positioned close to the entrance G and the insulator positioned far from the entrance G. Thus, the cooling rates of respective insulators mounted on the tray 210 can be substantially equalized with each other.

What is claimed is:

1. The method for manufacturing a spark plug which has a center electrode and a ground electrode to cause a spark discharge and has an electric resistor interposed between the center electrode and a stem equipped with a terminal, said manufacturing method comprising:

stuffing an electric resistive powder material in an inner hollow space of each insulator into which said center electrode and said stem are installed;

mounting a plurality of insulators each accommodating said electric resistive powder material on a tray;

conveying said tray carrying said plurality of insulators into a furnace;

thermally processing all of said plurality of insulators mounted on said tray in said furnace;

conveying said tray mounting said thermally processed plurality of insulators out of said furnace through an opening of said furnace; and inserting said stem in said inner hollow space of each insulator, wherein a windbreak is provided at a predetermined side of said tray that is close to said opening of said furnace when the tray is placed in said furnace, thereby preventing said thermally processed plurality of insulators from being directly cooled by the flow of air entering via said opening into said furnace, and said windbreak shields thermally processed plurality of insulators located close to said opening of said furnace at least at a portion thereof corresponding to said electric resistor from the flow of air entering into said furnace via said opening, thereby preventing the thermally processed insulators located close to said opening from being unevenly cooled by the air entering into said furnace via said opening when said tray mounting said thermally processed plurality of insulators are conveyed out of said furnace.

2. The method for manufacturing a spark plug in accordance with claim 1, wherein the tray has a plurality of holes, each receiving a respective insulator.

3. The method for manufacturing a spark plug in accordance with claim 2, wherein the windbreak is disposed so that an upper end thereof is higher than a portion corresponding to the resistor of the insulator received in the hole, whereby the windbreak prevents the resistor from being directly cooled by the air flowing into the furnace.

4. The method for manufacturing a spark plug in accordance with claim 1, wherein the tray has a rectangular base and wherein the windbreak is provided along at least one edge of the rectangular base to shield the insulators from being cooled by the flow of air.

5. The method for manufacturing a spark plug in accordance with claim 1, wherein the windbreak is positioned so that when the tray is in the furnace, the windbreak is positioned close to an entrance of the furnace.

6. The method for manufacturing a spark plug in accordance with claim 1, wherein the height h of the windbreak above an upper surface of the tray is greater than a height H of the top of the resistor from said upper surface of the tray.

7. The method for manufacturing a spark plug in accordance with claim 1, wherein the windbreak is an elongated, generally flat plate disposed along and projecting upwardly from said side of the tray.

8. The method for manufacturing a spark plug in accordance with claim 1, wherein the tray is conveyed into said furnace via said opening.

9. The method for manufacturing a spark plug in accordance with claim 1, wherein the windbreak is defined by an elongated, wavy or undulated plate.

10. The method for manufacturing a spark plug in accordance with claim 1, wherein the windbreak is perforated.

11. The method for manufacturing a spark plug in accordance with claim 10, wherein the perforations comprise a plurality of slits.

12. The method for manufacturing a spark plug in accordance with claim 1, wherein the windbreak comprises a surrounding windbreak extending along and upwardly from all peripheral sides of the tray.

13. The method for manufacturing a spark plug in accordance with claim 1, wherein the windbreak is welded to the tray.

14. The method for manufacturing a spark plug in accordance with claim 1, wherein the windbreak is formed integrally with the tray.

* * * * *